United States Patent [19]

Gross et al.

[11] 4,102,099

[45] Jul. 25, 1978

[54] INSULATING PANEL

[76] Inventors: Frank Robert Gross; Rubie Cook Gross, both of 3926 Wood Thrush Rd., Akron, Ohio 44313

[21] Appl. No.: 795,739

[22] Filed: May 11, 1977

[51] Int. Cl.[2] ..... E06B 7/12

[52] U.S. Cl. ..... 52/171; 52/616

[58] Field of Search ..... 52/616, 171, 311, 618, 52/86; 428/13; 350/259-263

[56] References Cited

U.S. PATENT DOCUMENTS

| | | | |
|---|---|---|---|
| 2,943,968 | 7/1960 | Freeman et al. | 350/263 UX |
| 3,193,434 | 7/1965 | Weiss | 52/311 X |
| 3,535,098 | 10/1970 | Babcock | 52/616 UX |
| 4,035,539 | 7/1977 | Luboshez | 52/616 X |

*Primary Examiner*—Ernest R. Purser
*Assistant Examiner*—Carl D. Friedman
*Attorney, Agent, or Firm*—Oldham, Oldham, Hudak & Weber Co.

[57] ABSTRACT

An insulating panel comprising a plurality of transparent plastic members, usually tubular and substantially rigid, positioned in parallel relation and extending over one surface of a glass sheet, and a transparent plastic cover sheet extending over at least the one surface of the glass sheet and the plastic members and secured to marginal areas of the glass sheet to form a unitary hollow insulating structure therefrom. Or two plastic cover sheets may secure tubular plastic members in the open center of an open center frame.

2 Claims, 8 Drawing Figures

INSULATING PANEL

BACKGROUND OF INVENTION

Heretofore there have been various efforts made to insulate greenhouses, as by whitewashing the windows when it is desired to reflect light and heat therefrom, or to paint the greenhouse windows green to shade the contents of the greenhouse. Furthermore, most greenhouses as made today, especially commerical greenhouses, have arrangements for heating the greenhouse and its contents to facilitate growth of the plants contained therein. Such cost of heating the greenhouse is one of the larger cost factors in the expenses of producing crops or products in the greenhouse. Snow may collect on the greenhouse roof and hamper flow of heat and light into the greenhouse.

Heretofore, it has been proposed that greenhouses use some relatively inexpensive plastic sheets to form spaced inner and outer walls or surfaces for the greenhouse to provide relatively inexpensive enclosure means therefor. One illustration of such type of a unit is shown in U.S. Pat. No. 3,080,875.

However, greenhouses as made and used today do have costly problems in their heating and in maintaining flow of the sun's rays to the greehhouse and its contents.

The general object of the present invention is to provide novel and improved low cost insulating roof panels or units for greenhouses to insulate the same and to permit the sun's rays to flow through the insulation panel into the greenhouse to reach the contents thereof.

Another object of the invention is to build up insulation panels from transparent plastic members both in tube and sheet form to form a unit that can be secured to a greenhouse glass pane and form an insulative, protective barrier layer thereover, which panel unit preferably is air tight and includes a confined air mass therein.

Other objects of the invention are to provide hollow insulating cover units or panels for part of a greenhouse roof to substitute for glass panes; to provide carrier frames for plastic panel units; and to provide low cost durable insulation panels that fit into the metal frames of greenhouses.

Yet another object of the invention is to make up standard insulating panels for greenhouses and wherein plastic components form the outer portion of the panel that is completed by a standard glass panel which can be positioned in standard greenhouse frame means.

The foregoing and other objects and advantages of the invention will be made apparent as the specification proceeds.

Figure 5:
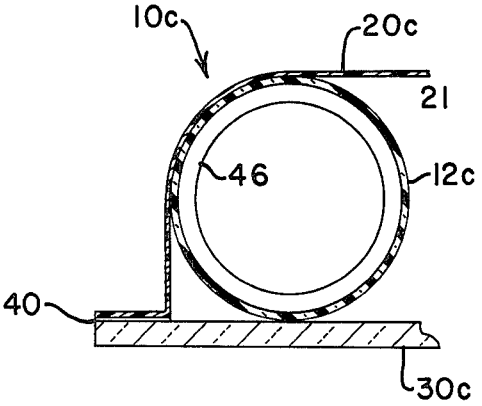
FIG. 5 is a fragmentary enlarged vertical section through an edge part of a further panel of the invention.
Figure 5A:
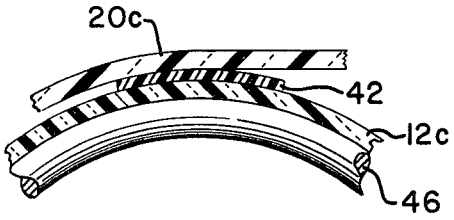
Figure 6:
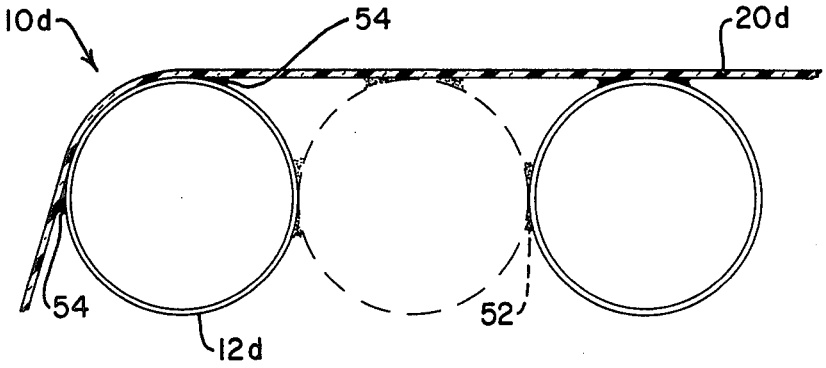
Figure 7:
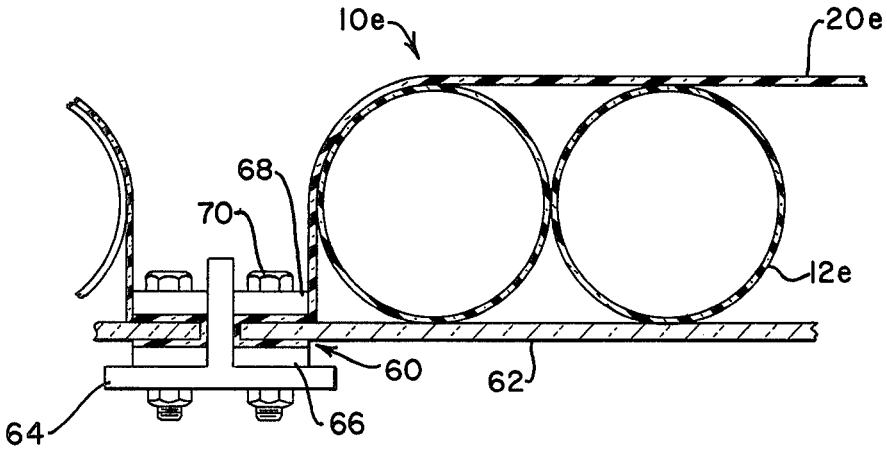

FIG. 5*a* is an enlarged section of the connection of the tube and cover sheet of FIG. 5;

FIG. 6 is a fragmentary vertical section through a panel of the invention as initially formed without a carrier panel; and FIG. 7 is a fragmentary section of modified panels of the invention as attached to a roof frame.

SUBJECT MATTER OF INVENTION

The insulating panel of the invention, as one embodiment thereof, comprises a plurality of transparent plastic members, preferably tubular and substantially rigid that may be positioned in parallel relation and extend along over one surface of a glass sheet, and a transparent plastic cover sheet extending over one surface of the glass sheet and the plastic members thereon and secured to marginal areas of the glass sheet to form a unitary hollow insulating structure therewith. The glass sheet can be omitted in some instances and top and/or bottom cover sheets can be positioned over the plastic members, and a rigid enclosure frame is provided for the plastic members and the plastic enclosure sheet is secured to the frame whereby the panel can be positioned in an opening in a greenhouse frame by the rigid frame.

Figure 1:
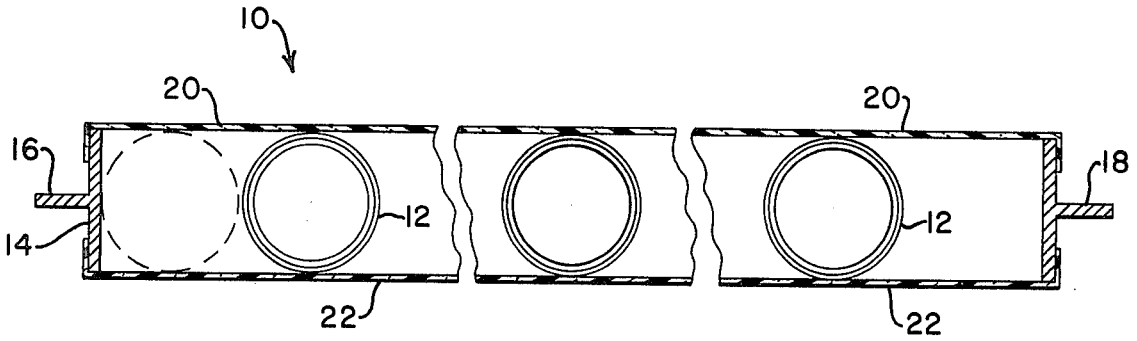
FIG. 1 is a vertical section through an insulating panel embodying the principles of the invention, taken on line 1—1 of FIG. 2.

Reference now is made to the details of the structure shown in the drawings, and this insulating panel is indicated as a whole by the numeral 10 in FIG. 1. This insulating panel comprises a plurality of transparent, usually tubular and substantially rigid plastic members 12 that are positioned within a rigid enclosure frame 14. These plastic tubes or members 12 are formed from any suitable materials such as polyethylene, polyvinyl chloride, etc. and they are relatively self supporting and at least semi-rigid. The frame 14 can be made from metal or plastic extrusion members secured together to form a hollow centered enclosure having at least a pair of laterally opposed attachement flanges 16, 18 protruding therefrom. Such flanges are sized with the frame 14 to be positioned within a standard window opening in a greenhouse frame of conventional construction. The tubes 12 are held in position in the panel 10 and a complete panel unit is formed therefrom by attaching top and bottom cover sheets 20 and 22 to the upper and lower edges of the open frame 14 and enclosing the plastic tubes 12 within the panel. Normally the plastic tubes are of substantially the same height or diameter as the height of the frame 14, as shown in FIG. 1.

Figure 2:
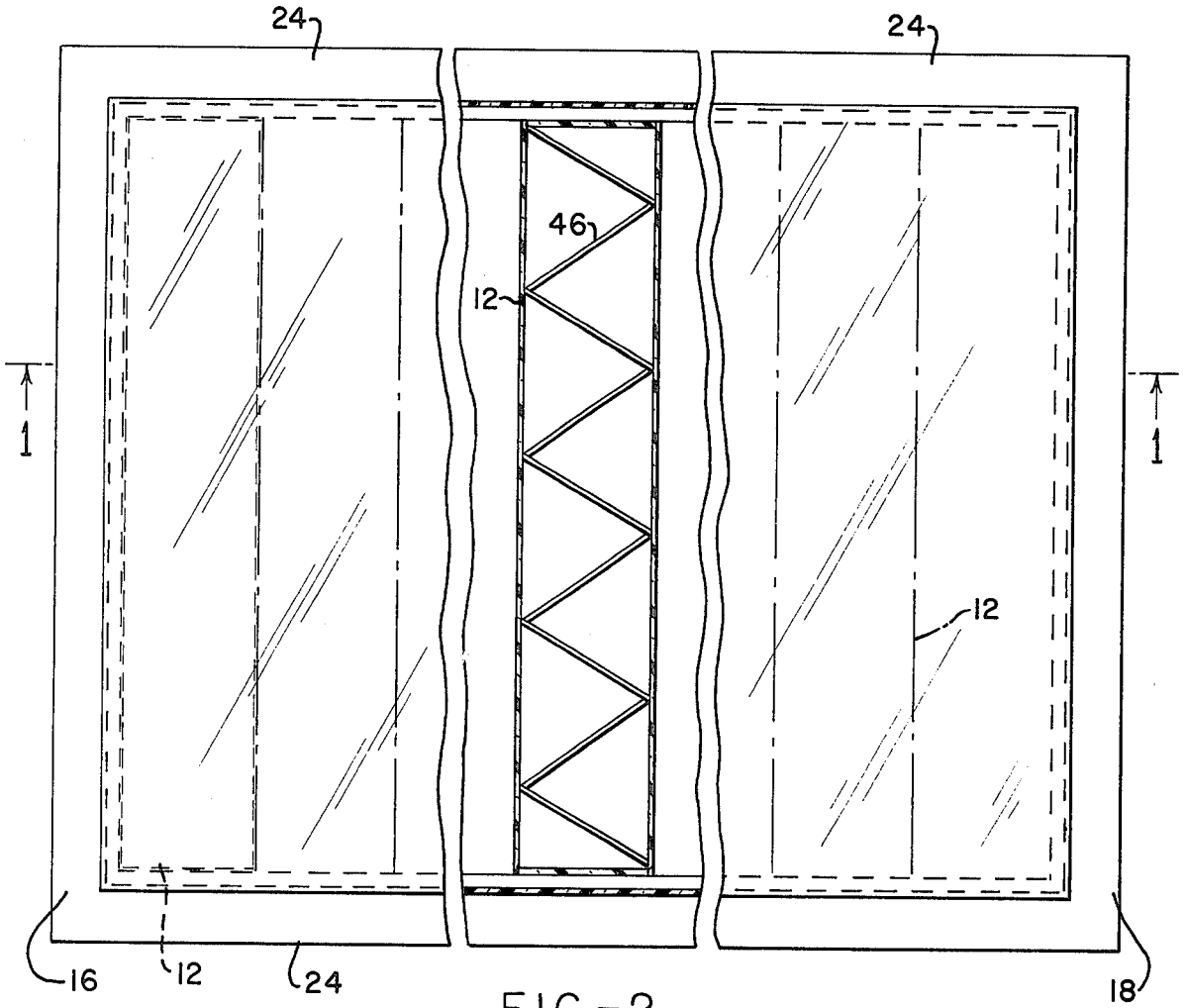
FIG. 2 is a plan, partly broken away and shown in section, of the panel of FIG. 1.

FIG. 2 shows a plan of the panel 10 and it may have opposed or protruding flanges 24, 24 formed on the opposite pair of margins of the panel, as desired.

It should be noted that the plastic tubes 12 can be abutted against each other as indicated in a portion of FIG. 1, or they can be spaced from each other, as desired. The plastic cover sheets 20 can be made from any conventional materials including polyvinyl chloride, Mylar, or other suitable material. Or, if desired, these cover sheets can even be of a laminated construction and include a Tetlar outer cover sheet secured by an adhesive or heat seal to the inner sheet. Tetlar is a fluoro polymer of DuPont and it is a tough inert plastic material that would provide weather resistant surfaces on these cover sheets. Such cover sheets can be attached to the frame 14 by suitable adhesives, or by a double faced conventional attaching tape or they can be heat seal bonded to the frame means, as desired, to provide an air tight insulation panel having a dead air space therein to aid in the panel's insulating properties.

Figure 3:
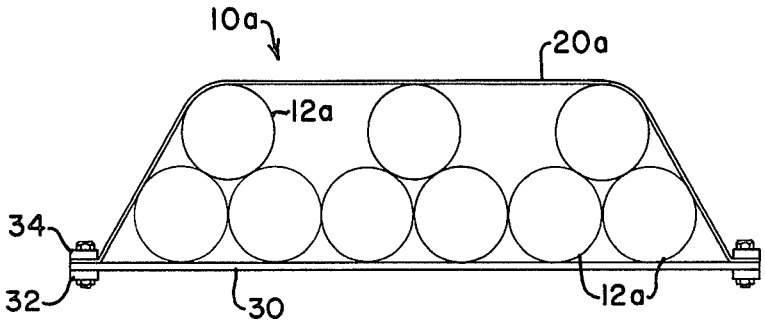
FIG. 3 is a diagrammatic vertical section of a modification of the insulating panel of FIG. 1.

FIG. 3 shows a modified panel 10*a* wherein a plurality of layers of plastic tubular members 12*a* are provided and it will be seen that the plastic tubular members 12*a* are arranged in two vertically abutted layers, and that these tubes in the layers can be abutted against each other at least in the bottom layer and be spaced from each other in the upper layer. Then an upper cover sheet 20*a* secures the tubular members to a glass pane 30 which is a carrier sheet for the panel. This glass pane 30 preferably is of standard size to be received in a greenhouse frame and be retained therein so that a part of a permanent fixed frame 32 would be shown with edge portions of the glass pane abutted thereagainst and with a removable cover frame section 34 retaining the glass pane and associated insulation panel in position.

Figure 4:
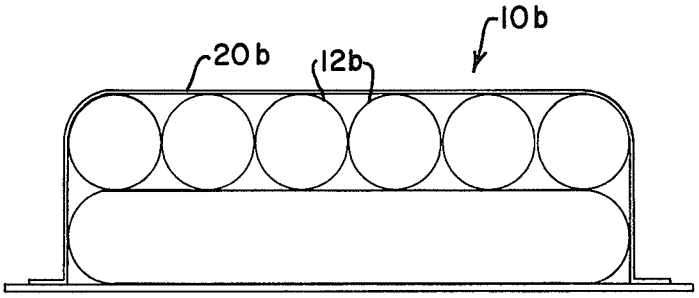
FIG. 4 is a vertical section, partly diagrammatic, through an insulating panel forming a further embodiment of the invention and wherein a plurality of insulation tubes are placed in layers in the panel, which layers extend at right angles to each other.

A modified insulating panel 10*b* is shown in FIG. 4 and in this instance, tubular members 12*b* are positioned in layers that have the tubes in criss-cross relationship to each other and are secured together into an integral insulation panel unit. Cover sheet 20*b* has its margins suitably bonded as by an adhesive to a glass pane carrier sheet.

FIGS. 5 and 5*a* show slightly enlarged views of a further modification of the insulation panel of the invention, and in this instance, an insulation panel 10*c* is shown that comprises a carrier glass pane 30*c* that has tubular members 12*c* positioned on one face thereof. These tubular members preferably are spaced from each other along the width of the panel, and with a tubular member 12*c* usually being provided at each lateral margin of the insulation panel wherein the cover sheet 20*c* extends down over and around this tubular member to be secured to the pane adjacent the margin thereof. Such sheet can be secured to the glass pane by heat bonding action, or by a double faced tape 40, as desired, so that an air tight enclosure is formed. The panel can be secured in an opening in a standard metal frame for a greenhouse.

FIGS. 5*a* of the drawings is an enlarged view of the upper portion of FIG. 5 wherein the plastic tube 12*c* is secured to the cover sheet by a double faced tape 42. Thus, the tubular members 12*c* can be attached to the cover sheet 20*c* in desired relationship by these tapes and then be attached as a unit to the glass pane 30*c*. By the cover sheet, dead air space is provided within the insulation panel. FIG. 5*a* shows that this tubular member has a lightweight helical reenforcing spring 46 suitably positioned therein. Such spring can just be frictionally forced into the bore of this tube 12*c* to be engaged therewith. Or, if desired, separate axially spaced rings can just be forced into the tubular members 12*c* and be retained therein for reenforcing the same against radial compression actions. The springs 46 can be made from metal or plastic, and such springs may be used in any wall of the plastic tubes used in structures of the invention. A spring 46 is also shown in FIG. 2 but such springs can be omitted if desired, especially in this framed construction. But springs alone of suitable helical shape and diameter can be used alone, as by being cemented or bonded to a carrier sheet that in turn would be secured to a glass pane as shown in FIG. 5.

The tubular members 12*c* and/or the equivalent structures shown in other figures are either of relatively rigid construction initially, or they are made substantially rigid by positioning the reenforcing springs 46 therein to aid in providing some support action for any load applied to the insulation panels of the invention. The plastic tubes and sheets can be of any suitable wall thickness such as about 0.001 to 0.020 for the tubes and about 0.004 to 0.006 for the films or sheets. The tubes form dead air pockets in the panels.

Yet another modified panel 10*d* of the invention is shown in FIG. 6. Such panel 10*d* has a plurality of plastic tubular members 12*d* that preferably are cemented or otherwise secured to each other at 52 and/or to a cover sheet 20*d* as at 54. If it is desired to have these tubular members 12*d* abutted against each other, they can be heat sealed or be cemented to each other or be secured together by being attached to a carrier means such as the cover sheet to facilitate their handling. Hence, a continuous layer of insulation is in effect formed for attachment to a glass pane to be handled as a unit therewith and be positioned in a greenhouse window frame in a manner described heretofore by edge or flange portions of the glass pane or its carrier frame. The cover sheet 20*d* will have its edges or margins suitably secured to edge portions of a glass pane as by adhesive tape to provide a self-supporting insulation panel. Or these tubes or springs can be parallel but spaced from each other and be secured solely to the cover sheet.

FIG. 7 shows a panel 10*e* with an edge flange 60 thereon. A cover sheet 20*e* extends over a plastic tube 12*e* and around (usually) an edge of the glass pane carrier 62. A greenhouse frame 64 may have an edge flange 66 receiving the edge flange 60 thereon. A cover or anchor strip 68 secures the panel 10*e* to the frame by a bolt 70.

The transparent tubes 12 of FIG. 1 can be secured to one or both of the cover sheets 20 and 22 by double-faced adhesive tapes or otherwise if desired, or the tubes may just be loosely frictionally held in place.

Note that the tubular members of FIG. 3 are arranged to nest with each other to stay in position.

The transparent insulation panels 10 et al of the invention are suitably secured to frame supports by conventional means and removable cover strips may aid in such attachment. The tubes and cover sheets are of compositions and sizes as to provide suitable strength in the panels that are strengthened by the lightweight metal reenforcing springs 46, as required.

The term transparent is used broadly to cover any slight translucence in the tubes and cover sheets of the insulation panels.

From the foregoing, it will be seen that a relatively lightweight, inexpensive but sturdy insulation panel has been provided by this invention. This panel may be used in place of the glass pane normally positioned in a greenhouse frame, or a glass pane carrier of the same size as used in the greenhouse frame can be used and have the insulation panel of the invention built up therearound whereby the insulation panel will readily fit into the frame provided.

While several complete embodiments of the invention have been disclosed herein, it will be appreciated that modification of these particular embodiments of the invention may be resorted to without departing from the scope of the invention.

What is claimed is:

1. An insulating panel for a greenhouse comprising a plurality of transparent tubular plastic members positioned in a layer, a light transmitting support structure with said plastic members on one face thereof, a transparent cover sheet means extending over at least one surface of said plastic members and secured to said support structure to form a unitary insulating structure therefrom, and a reenforcing coil spring received in and supporting each of said tubular plastic members.

2. An insulating panel comprising a plurality of tubular members, a support frame means operatively engaging said tubular members and positioning them in an open center thereof, transparent cover sheet means extending over said tubular members and secured to said frame means to form an operative insulating structure therefrom, and said reenforcing means comprising a metal coil spring one of which is received in and reenforces each one of said tubular members, said tubular members being made of transparent plastic material.

* * * * *